US006669193B2

(12) United States Patent
Lovaghy

(10) Patent No.: US 6,669,193 B2
(45) Date of Patent: Dec. 30, 2003

(54) DEVICE FOR ALIGNING PAPERS FLOWING IN A STREAM

(76) Inventor: John Lovaghy, 96 Napoleon, Mascouche, Quebec (CA), J7L 3B2

( * ) Notice: Subject to any disclaimer, the term of this patent is extended or adjusted under 35 U.S.C. 154(b) by 0 days.

(21) Appl. No.: 10/146,360

(22) Filed: May 14, 2002

(65) Prior Publication Data

US 2003/0001329 A1 Jan. 2, 2003

(30) Foreign Application Priority Data

May 14, 2001 (CA) ..... 2347562

(51) Int. Cl.[7] ..... B65H 9/04

(52) U.S. Cl. ..... 271/245; 271/237; 271/234; 198/459.5

(58) Field of Search ..... 271/245, 246, 271/234, 286, 237, 285; 198/459.5, 459.6, 462.1, 466.3

(56) References Cited

U.S. PATENT DOCUMENTS 4,213,604 A * 7/1980 Sato ..... 271/233
4,360,196 A * 11/1982 Weisbach ..... 271/235
4,746,004 A * 5/1988 Hess et al. ..... 198/418.9
5,445,368 A * 8/1995 Lester et al. ..... 270/59

* cited by examiner

*Primary Examiner*—Donald P. Walsh
*Assistant Examiner*—Kaitlin Joerge
(74) *Attorney, Agent, or Firm*—Eric Fincham

(57) ABSTRACT

An apparatus for adjusting paper copies which are skewed and for providing a shingled stream, the apparatus including an input, a singulating device having a vertically movable gate member, a first abutting surface formed on the gate member, a second fixed abutting surface formed rearwardly of the movable gate member, a gate member being reciprocally driven in a vertical direction, and an output section to receive copies from the singulating device. The apparatus can be used in conjunction with other copy handling machines such as various integrators.

5 Claims, 8 Drawing Sheets

DEVICE FOR ALIGNING PAPERS FLOWING IN A STREAM

FIELD OF THE INVENTION

The present invention relates to a device known as a stream adjuster.

BACKGROUND OF THE INVENTION

In the printing industry, shingling of streams of paper is one of the basic processes utilized in web printing. Shingling originally started out as a means to handle increased production speeds. A single file stream spaced by copies width typically travels at a surface speed which can be six times higher than shingled copies with a 2" shingle pitch. As the years have passed, many additional pieces of equipment such as folders, trimmers, and stackers have assumed that the incoming stream of copies to be processed would be shingled. One of the well known methods of shingling is know as the fly shingling apparatus which is relying on precise mechanical timing such that it contributes to lower products which can be as low as 50% of the design speed of the web press which it serves.

One of the problems associated with high speed operation of many of these devices is that if the incoming stream of product is not precisely aligned, and spaced, problems will occur.

SUMMARY OF THE INVENTION

It is an object of the present invention to provide a steam adjuster which can handle misaligned product.

According to one aspect of the present invention, there is provided an apparatus for adjusting paper copies comprising an input conveyor, a singulating device having a vertically moving gate member, a first abutting surface formed on the movable gate member, a second fixed abutting surface formed rearwardly of the movable gate member, means for moving the gate member vertically in a reciprocal manner; and an output conveyor to receive copies from the singulating device.

The stream adjuster of the present invention permits the straightening and shingling of misaligned copies and can be used as a portion of an integrator machine wherein two sets of stream adjusters can process two incoming streams of copies from two individual conveyors in order to integrate them into one stream. The stream adjusters can be perfectly timed to work together so that both streams of books which meet together at one point accurately overlap one another.

The stream adjuster of the present invention can also be incorporated in other copy handling apparatuses and such machines are well known in the art.

BRIEF DESCRIPTION OF THE DRAWINGS

An embodiment of the present invention will be illustrated and having regard to the following drawings, in which.

DESCRIPTION OF THE PREFERRED EMBODIMENTS

Figure 1:
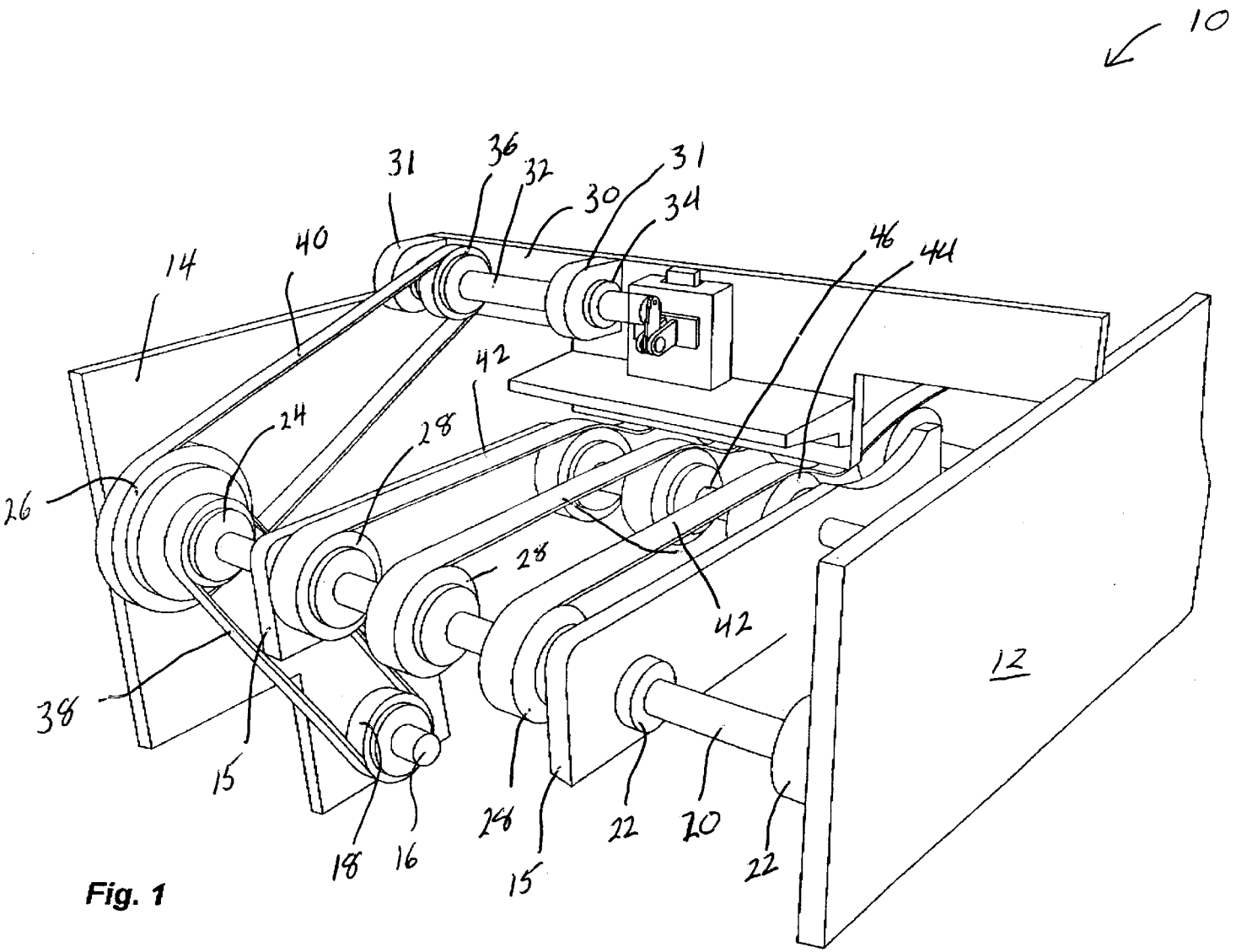
FIG. 1 is a perspective view of the front end of a stream adjuster according to the present invention.

Referring to the drawings in greater detail and by reference characters thereto, there is illustrated in FIG. 1 a portion of a stream adjuster apparatus according to the present invention and which is generally designated by reference numeral 10.

Stream adjuster 10 has a pair of housing side walls 12 and 14 intermediate of which there are provided a pair of plates 15. A motor 25 (FIG. 7) has a motor shaft 16. Mounted on shaft 16 is a pulley 18.

Extending between housing side walls 12, 14 and through plates 15 is a shaft 20 suitably mounted within bearings 22.

Mounted on shaft 20 are a plurality of pulleys; a first relatively large diameter pulley 26 is mounted adjacent side wall 14 while mounted inwardly therefrom is a smaller diameter pulley 24.

Three pulleys 28 are mounted intermediate plates 15 for reasons which will become evident hereinbelow.

A cross member 30 extends between housing side walls 12, 14 and includes flanges or ears 31 extending outwardly therefrom. Extending between flanges 31 is a shaft 32 suitably mounted in bearings 34. Mounted on shaft 32 is a pulley 36.

A drive belt 38 extends between pulley 18 mounted on motor shaft 16 and pulley 24 mounted on shaft 20 to thereby rotatably drive shaft 20. A second drive belt 40 extends between pulley 26 on shaft 20 and pulley 36 on shaft 32 to thereby rotatably drive shaft 32. A plurality of eagle belts 42 extending about pulleys 28 and are further supported by pulleys 44 on a shaft 46 as will be discussed in greater detail hereinbelow.

Figure 7:
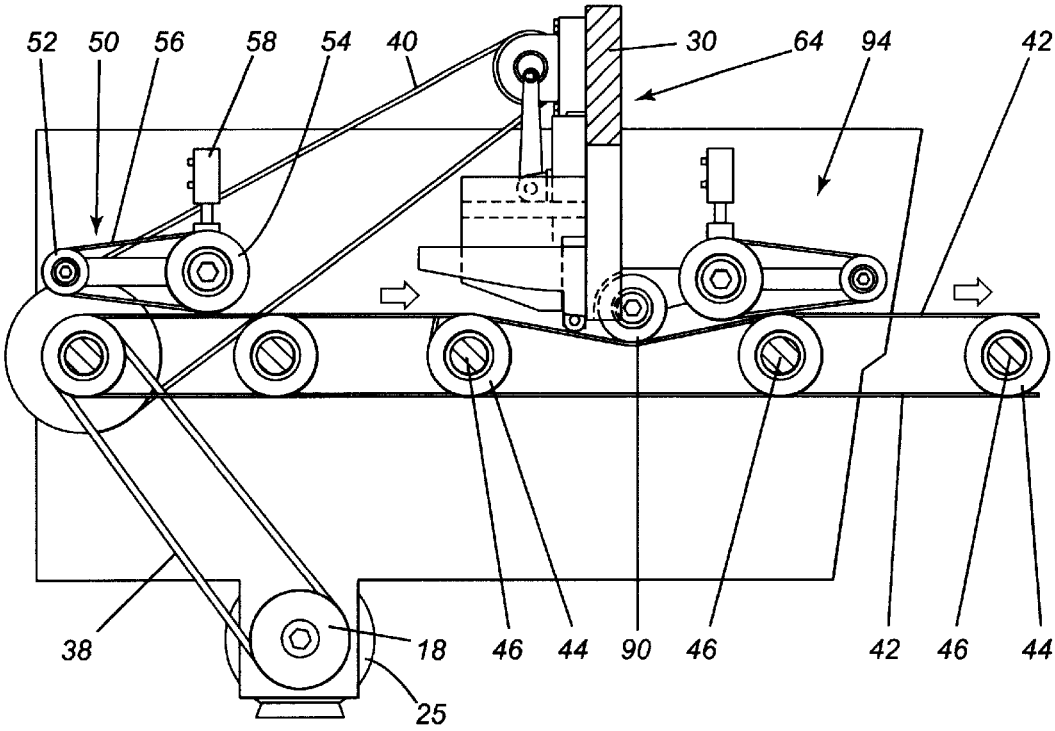
FIG. 7 is a side sectional view taken along the lines 7—7 of FIG. 6.
Figure 8:
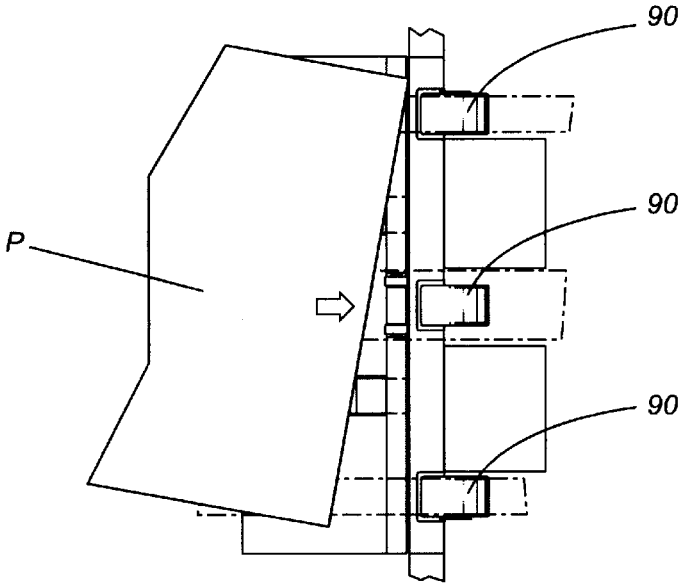
FIG. 8 is a top plan view showing the entry of a sheet of product for alignment.
Figure 9:
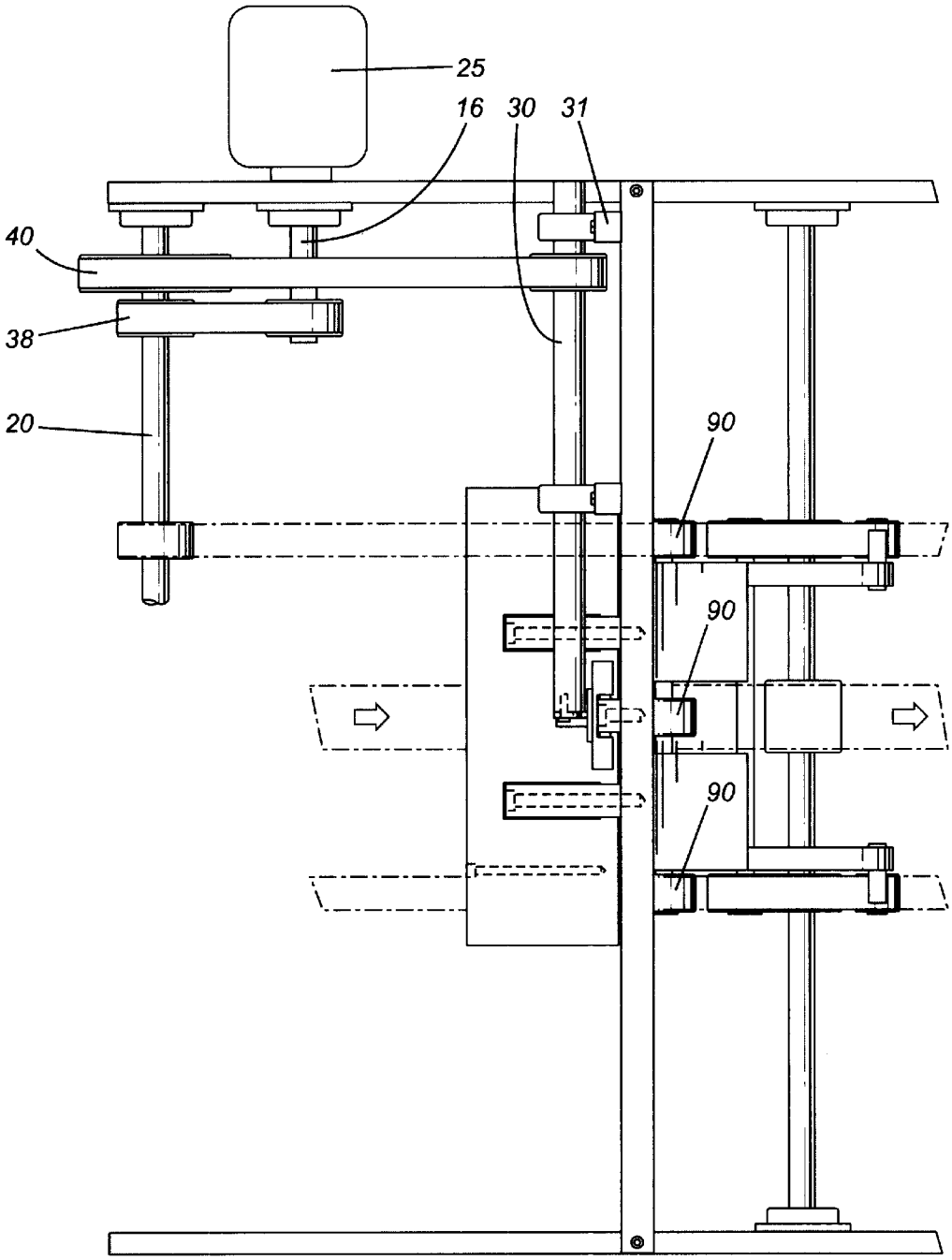
FIG. 9 is a top plan view of a portion of the stream adjuster.
Figure 10:
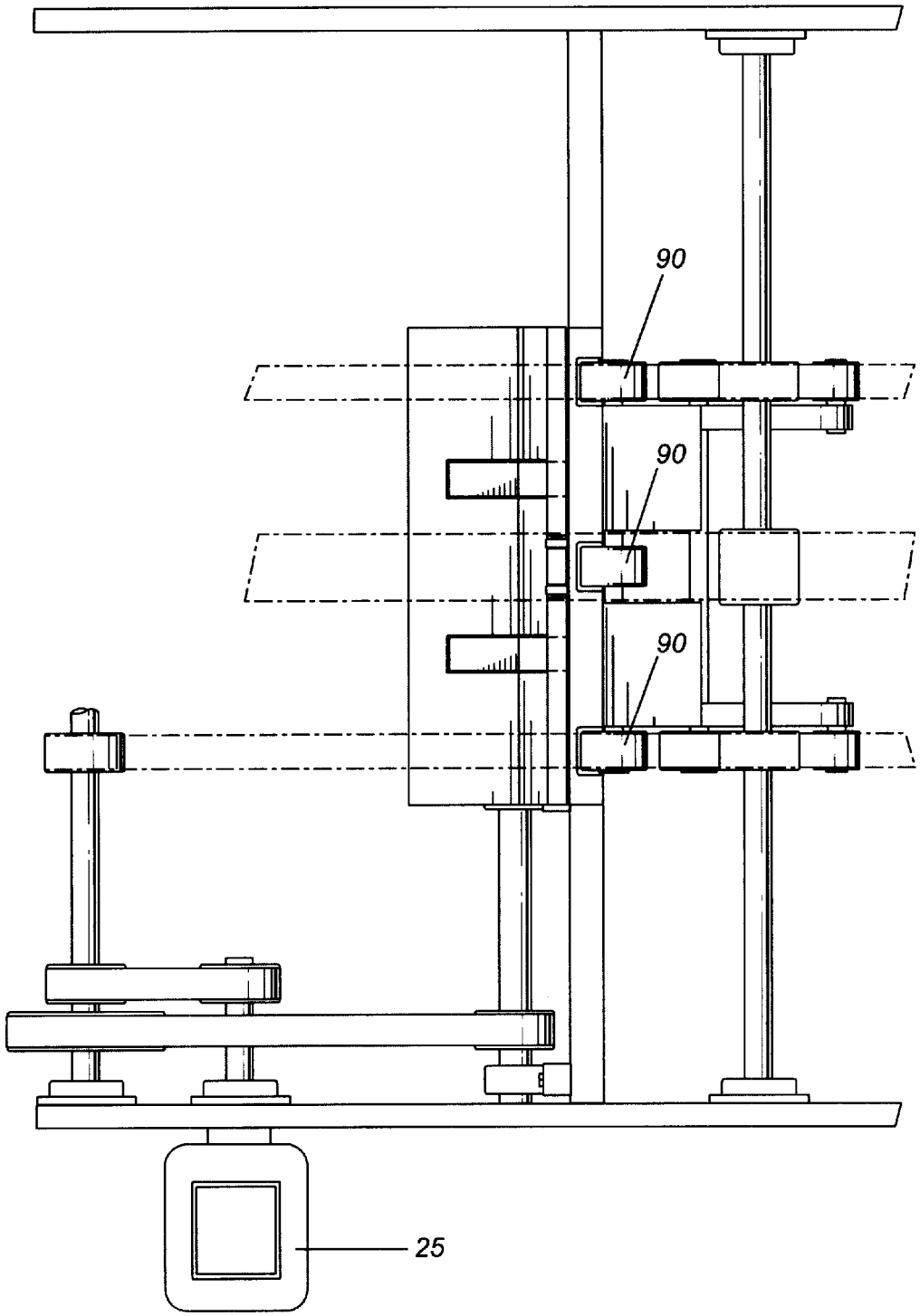
FIG. 10 is a bottom plan view thereof.

As may be best seen in FIG. 7, there is provided an input assembly generally designated by reference numeral 50 which serves to nip the input product to eagle belts 42. To this end, there are provided a pair of rider wheels 52 and 54 connected by a belt 56. An air cylinder 58 allows for adjustment thereof. There is a similar assembly on the other side.

Figure 11:
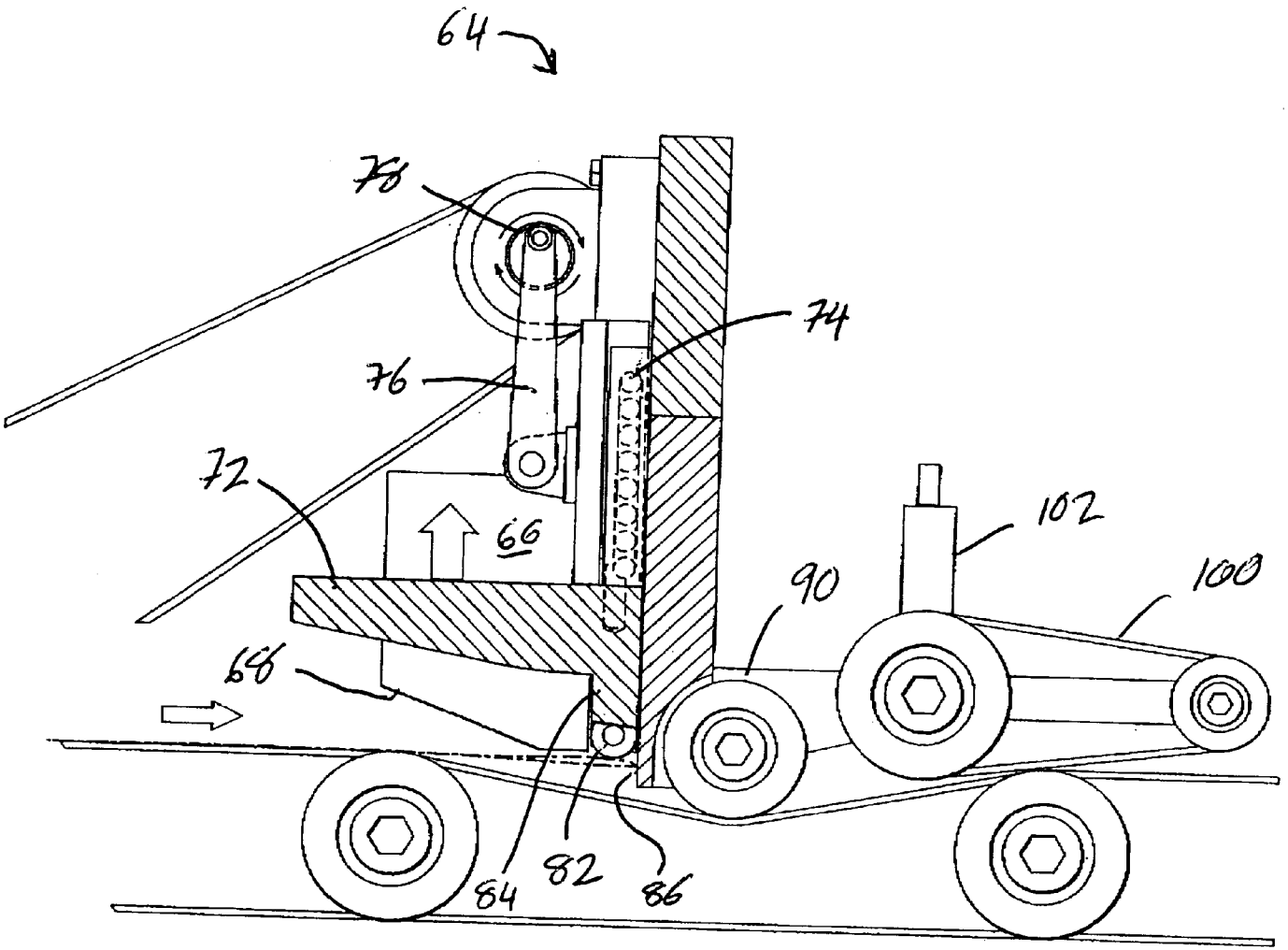
FIG. 11 is a side elevational view of a portion of the stream adjuster showing the pusher in an upper position.
Figure 12:
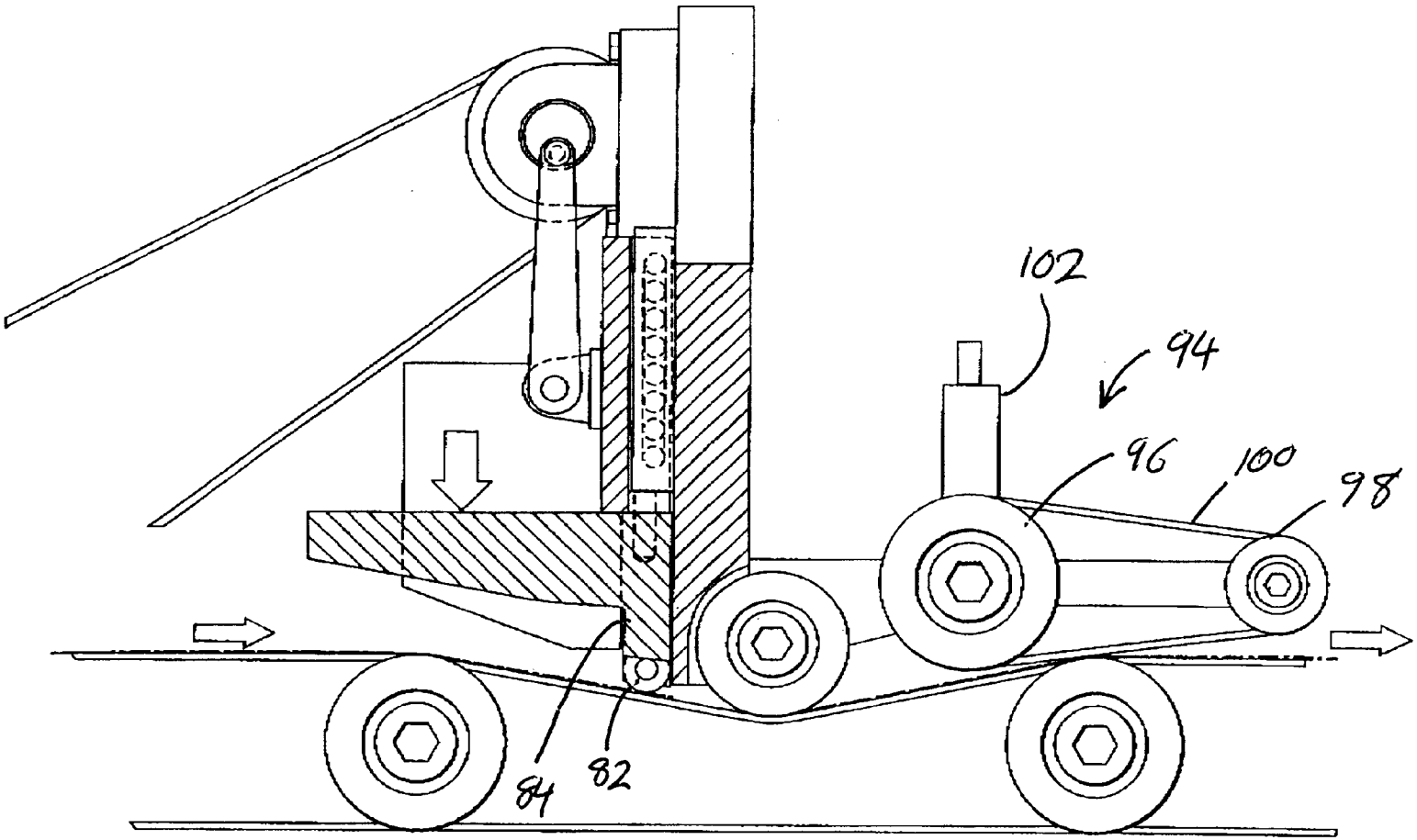
FIG. 12 is a view similar to FIG. 11 showing the pusher in a lower position.

As may be best seen in FIGS. 11 and 12, there is provided a singulating unit which is generally designated by reference numeral 64. Singulating unit 64 includes a fixed member 66 having a lower surface functioning as a guide 68.

There is provided a moveable gate 72 which is mounted in bearing 74. Gate 72 is driven by means of a shaft 76 connected to cam 78 which is mounted on shaft 32. At the bottom of gate 72, there are provided center wheels 82 which are small ball bearing wheels located in the main body of gate 72. As may be seen in FIGS. 11 and 12, there is provided a first abutting surface 84 formed on gate 72 while rearwardly thereof there is a second abutting surface 86.

Mounted rearwardly of gate 72 are three guide wheels 90 which are fixed and mounted to depress eagle belts 42 preferably ⅞ of an inch.

There is also provided an output assembly 94 similar to input assembly 50. Thus, there are provided first and second rider wheels 96 and 98 interconnected by a belt 100 while an air cylinder 102 is provided to permit adjustment.

Figure 3:
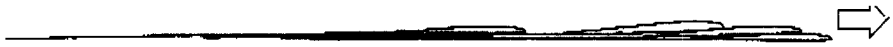
FIG. 3 is a side elevational view of the product of FIG. 2.
Figure 2:
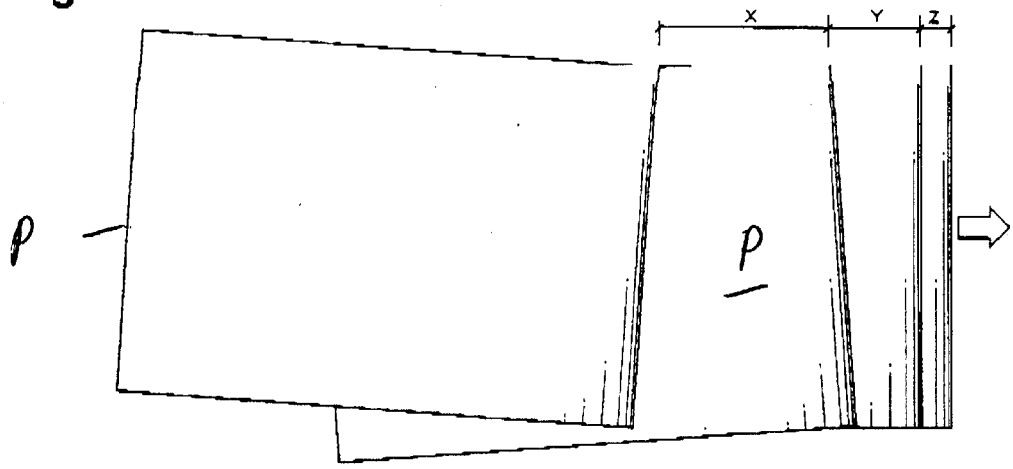
FIG. 2 is a top view of a misaligned product as it may be presented to the stream adjuster of the present invention.
Figure 5:
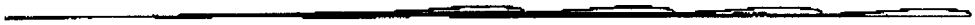
FIG. 5 is a side elevational view thereof.
Figure 4:
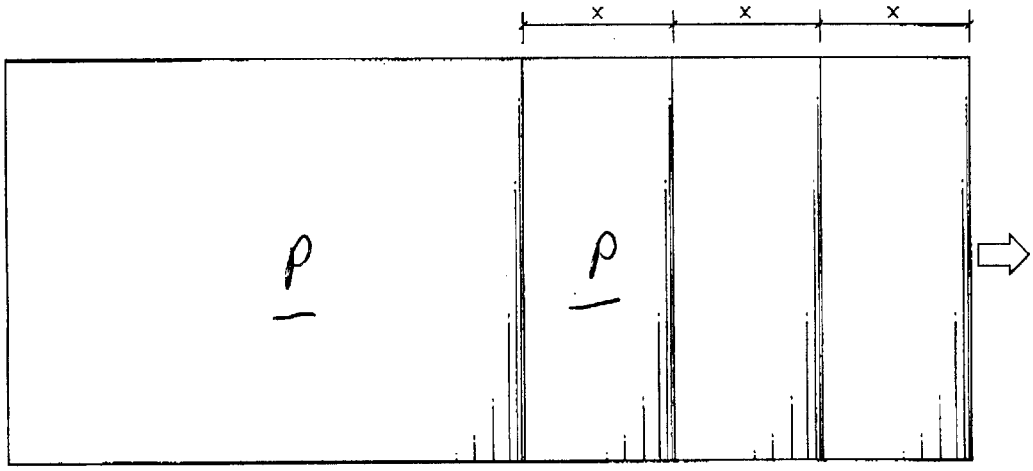
FIG. 4 is a top plan view of the product after passing through the stream adjuster of the present invention.
Figure 6:
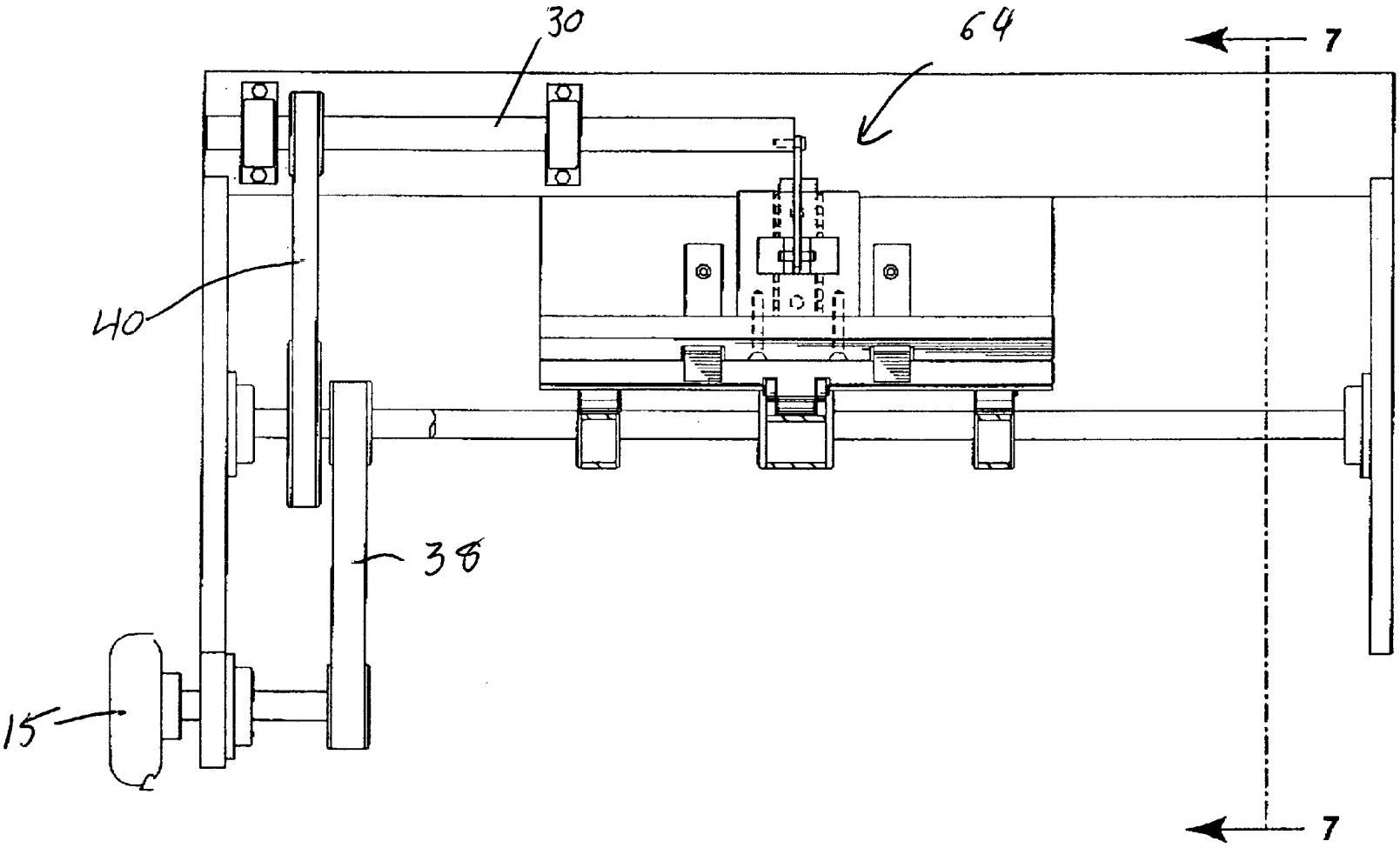
FIG. 6 is a front elevational view of the stream adjuster of the present invention.

In operation, a stream of product is fed into the stream adjuster 10. As shown in FIGS. 2 and 3, the product P may be misaligned and separated by varying amounts as shown by reference characters X, Y and Z. After passing through the stream adjuster 10 of the present invention, there are shingled with uniform spacing as indicated by reference character X.

At input assembly 50, the product P is nipped securely to the eagle belts 42 and this provides immediate traction. Thus, the speed at which the copies should be processed into the stream adjuster is matched and the arrangement is such to advance the copies to the singulating mechanism.

Guide 68 is there to guide any incoming product which is either slightly curved upwardly or copies which may have lifted slightly because of the speed at which the product is traveling along the conveyor. Stripper fingers guide the product at a decreased angle towards the gate and prevent the copies from lifting up when they are moved forward.

The shingle width is determined by the ratio of sprockets on wheels 26 and 36. Depending on the number of teeth on each sprocket or wheel, the width between the copies of the product may be increased or decreased.

When a skewed copy hits either first abutting surface 84 or second abutting surface 86, it will automatically be corrected towards a 90° placement. A first copy will hit first abutting surface 84. Upon movement of gate 72 upwardly, the copy will proceed through the gate and under three guide wheels 90. When the gate is in an upper position, second abutting surface 86 is utilized to stop the next copy of the product. A downward movement of a gate 72 will then allow the product to be released from second abutting surface 86 and pass through the gates and guide wheels 90.

It will be understood that the above described embodiment is for purposes of illustration only and that changes and modifications may be made thereto without departing from the spirit and scope of the invention

I claim:

1. An apparatus for adjusting paper copies comprising:

an input conveyor;

a singulating device having a vertically movable gate member, a first abutting surface formed on said movable gate member, a second fixed abutting surface formed rearwardly of said movable gate member, means for moving said gate member vertically in a reciprocal manner; and an output conveyor to receive copies from said singulating device.

2. The apparatus of claim 1 wherein said singulating device further includes guide means situated at an input end of said singulating device.

3. The apparatus of claim 1 wherein said input conveyor includes an input assembly to nip said copies to said input conveyor.

4. The apparatus of claim 3 wherein said movable gate member includes a plurality of wheels on a bottom surface thereof.

5. The apparatus of claim 1 wherein said input conveyor and said output conveyor have common conveyor belts, and further including means for depressing said conveyor belts rearwardly of said singulating device.

* * * * *